US009168671B2

(12) United States Patent
Englund et al.

(10) Patent No.: US 9,168,671 B2
(45) Date of Patent: Oct. 27, 2015

(54) METHOD AND ARRANGEMENT FOR A SAWCHAIN

(75) Inventors: Tommy Englund, Umeå (SE); Per Hedström, Umeå (SE)

(73) Assignee: Komatsu Forest AB, Umea (SE)

( * ) Notice: Subject to any disclaimer, the term of this patent is extended or adjusted under 35 U.S.C. 154(b) by 501 days.

(21) Appl. No.: 13/119,381

(22) PCT Filed: Sep. 25, 2008

(86) PCT No.: PCT/SE2008/051075
§ 371 (c)(1),
(2), (4) Date: Jun. 9, 2011

(87) PCT Pub. No.: WO2010/033061
PCT Pub. Date: Mar. 25, 2010

(65) Prior Publication Data

US 2011/0226112 A1 Sep. 22, 2011

(30) Foreign Application Priority Data

Sep. 17, 2008 (SE) ..... 0801985

(51) Int. Cl.
*B27B 33/14* (2006.01)

(52) U.S. Cl.
CPC ..... *B27B 33/14* (2013.01); *Y10T 83/909* (2015.04)

(58) Field of Classification Search
USPC ..... 30/381–382; 83/830–834
See application file for complete search history.

(56) References Cited

U.S. PATENT DOCUMENTS

| | | | | | |
|---|---|---|---|---|---|
| 1,273,394 | A | * | 7/1918 | Meyer | 30/381 |
| 1,419,968 | A | * | 6/1922 | Johnson | 116/23 |
| 1,766,013 | A | * | 6/1930 | Daw | 83/830 |
| 1,779,083 | A | * | 10/1930 | Bens | 83/832 |
| 2,488,343 | A | * | 11/1949 | Standal | 30/387 |
| 2,583,243 | A | * | 1/1952 | Tweedie | 83/831 |
| 2,749,950 | A | * | 6/1956 | Jamieson et al. | 83/831 |
| 2,798,517 | A | * | 7/1957 | Carney | 83/830 |

(Continued)

FOREIGN PATENT DOCUMENTS

BE 419968 A 3/1937

OTHER PUBLICATIONS

International Search Report from corresponding International Application No. PCT/SE2008/51075.

*Primary Examiner* — Sean Michalski
*Assistant Examiner* — Jonathan G Riley
(74) *Attorney, Agent, or Firm* — Renner, Otto, Boisselle & Sklar, LLP

(57) ABSTRACT

The invention concerns a method for a sawchain and a sawchain. According to the method according to the invention, a sawchain intended to be used for a sawing arrangement for a forestry harvester in order to prevent the whip-like movement of a sawchain that breaks during sawing, is achieved through a method that comprises the steps: —that the sawchain (1) is provided with a means (20) of limiting pivoting that allows a forwardly located link (3, 4, 5, 2) of the sawchain to pivot in a first direction relative to the subsequent link (3, 4, 5, 2) while limiting the ability of the forwardly located link to pivot in an opposite second direction relative to the subsequent link, —that the sawchain (1) is driven around a guide bar (9) with the aid of a driving wheel that is located at one end of the guide bar, —that sawing of a tree trunk is carried out through the guide bar (9) being turned around an axis of rotation.

12 Claims, 4 Drawing Sheets

(56) References Cited

U.S. PATENT DOCUMENTS

Figure 1:
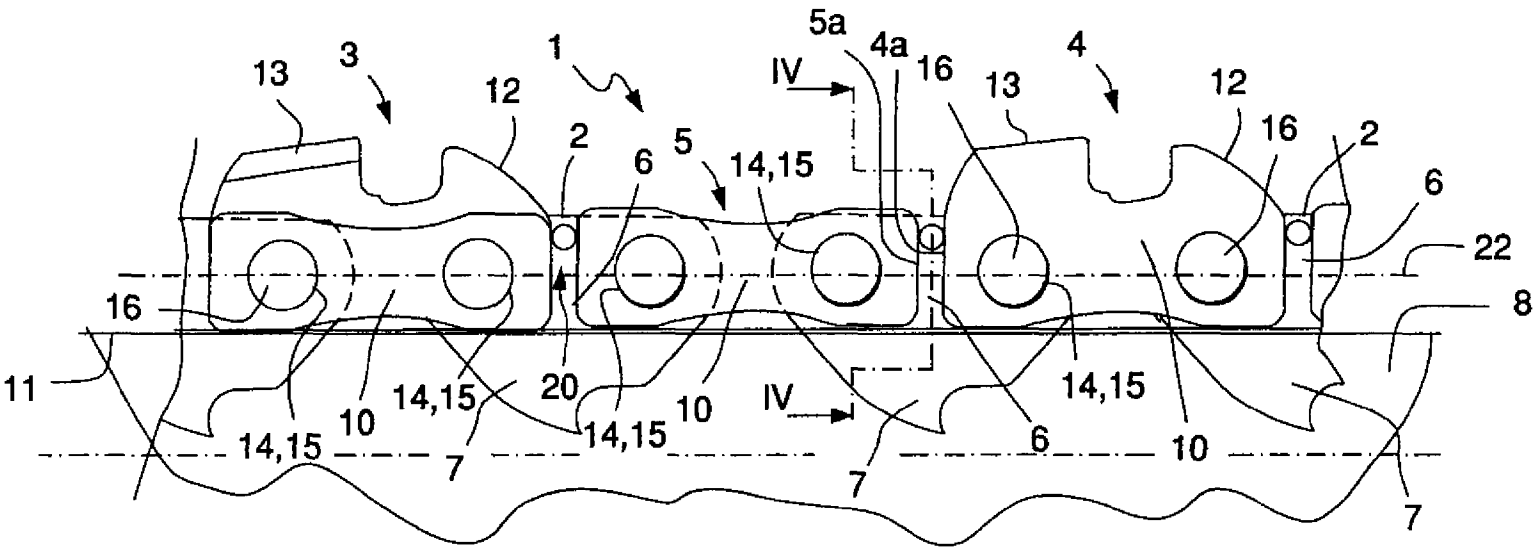

| | | | | | |
|---|---|---|---|---|---|
| 3,124,179 | A | * | 3/1964 | Cavero | 83/832 |
| 3,283,789 | A | * | 11/1966 | Silvon | 30/384 |
| 3,910,147 | A | * | 10/1975 | Heyerdahl | 83/830 |
| 4,074,604 | A | * | 2/1978 | Goldblatt et al. | 83/830 |
| 4,309,931 | A | * | 1/1982 | Alexander | 83/832 |
| 4,353,277 | A | * | 10/1982 | Silvon | 83/833 |
| 4,546,755 | A | * | 10/1985 | Gustavsson | 125/21 |
| 4,558,621 | A | * | 12/1985 | Nitschmann et al. | 83/834 |
| 4,562,761 | A | * | 1/1986 | Alexander | 83/830 |
| 4,796,502 | A | * | 1/1989 | Anderson | 83/834 |
| 5,042,350 | A | * | 8/1991 | Nitschmann | 83/522.11 |
| 5,184,598 | A | * | 2/1993 | Bell | 125/21 |
| 5,226,404 | A | * | 7/1993 | Mogi et al. | 125/21 |
| 5,988,035 | A | * | 11/1999 | Rossmann | 83/830 |
| 6,138,658 | A | * | 10/2000 | Bell | 125/21 |

* cited by examiner

METHOD AND ARRANGEMENT FOR A SAWCHAIN

The present invention concerns a method for a sawchain according to the introduction to claim 1 and a sawchain according to the introduction to claim 4. The invention concerns also the use of such a sawchain.

The sawchain that is a component of the sawing device of a motor-driven sawing device is guided along a groove in the peripheral part of a guide bar and it takes at the outermost end or point of the guide bar a path that has a relatively small radius of curvature. Sawchains of this type generally comprise a linked or a mutually guided series of cutting links with cutters located at the sides, these cutters being alternately directed towards one side and the other side, a number of non-cutting intermediate links, known as intermediate links, that are united with the cutting links in a manner that allows pivoting, and a number of driving links, which are centrally located in the chain and whose driving tongue interacts with a peripheral groove that is located around the guide bar, in order to guide the passage of the chain, and with a driving wheel that is located at the end of the guide bar. The cutting links are designed as pairs consisting of one cutting link and one side link, these being united in a manner that allows pivoting with the central driving link through a rivet that functions as a pivot pin. The non-cutting links are designed in a similar manner as pairs consisting of two side links, that are united with the central driving link through a rivet in a manner that allows pivoting. Not only the cutting links but also the non-cutting links can be pivoted relative to each other in the principal plane of the guide bar through the rivet.

One of the more common areas of use for sawchains, in addition to their use in hand-operated saws, is for a crane-borne saw device, known as the "felling head" of a forestry harvester, the task of which is to fell a growing tree and to cut up the tree trunk obtained in this manner into logs of predefined lengths. The saw device that carries out the sawing operation is mounted in a protective saw box and has, in addition to a base structure, a saw motor, a driving wheel for driving the chain, a guide bar, a sawchain, a holder for the guide bar, and an element for carrying out a cutting action by feeding the guide bar into and out of the saw box. The saw motor is arranged to drive the sawing wheel, which in turn causes the sawchain to rotate around the pivotable guide bar. Efficient felling requires that the sawchain rotate at very high rotation speeds around the guide bar. One dangerous situation that can arise when sawing using the said type of saw device is, as a result of the high chain speeds, breakage of the sawchain through the failure of any one chain link, whereby parts that have been released by the broken chain, individual sawteeth, side links, driving links, or other parts that are released at high speed into the surroundings may cause serious injury. Such a situation may give rise not only to damage to objects but also injury to persons who are located in the vicinity of the area of operation of the forestry harvester. The said released parts are normally known by the general term "chain shot", and may reach speeds that are comparable with those of pistol shots. Research has shown that chain shots normally arise through the powerfully oscillatory movement of the rear part or the free end of the broken sawchain that occurs during the backwards return movement of the chain and its oscillation outwards from the point or end of the guide bar. The rear part of the broken sawchain thus performs a rapid whip-like movement backwards and forwards, which not seldom results in parts becoming freed from the end of the chain and flying out into the surroundings. The present invention thus has its principal area of use for sawchains that are intended to be used in a saw device, the felling head of a forestry harvester.

One purpose of the present invention is to achieve a method of preventing the powerful oscillatory movement of the free end of a broken sawchain, and preventing its return movement that leads to parts of the sawchain becoming more readily detached from the broken chain. This purpose of the invention is achieved through the dimensions and stages that are specified in claim 1. A sawchain with such a design that the risk of chain shot has been eliminated is achieved with the characteristics and properties that are specified in claim 4. Further advantageous characteristics of the present sawchain are made clear by the non-independent claims.

It is one advantage of the present invention that it prevents the forwards and backwards motion of the free end of the chain in the event of chain breakage. In other words, it prevents the movement of the end of the chain out from the end of the guide bar, and thus also the whiplash effect.

Previously known arrangements for solving this problem have generally been directed towards increasing the enclosure of the chain in the saw box with fixed and moveable protection and walls. It is, however, not possible to seal the saw box completely since it must be possible for sawdust to leave the saw box. The saw box, furthermore, must be sufficiently open to make it possible to carry out not only sawing, but also maintenance and repair simply.

The present invention aims instead at solving the problems of chain shot by ensuring that the sawchain is given such a design that the risk of chain shot occurring is eliminated. Thus, in contrast with previous safety systems, which have been directed towards enclosing chain shot, the present invention eliminates the possibility of chain shot arising at all. Among the many advantages of this is that it makes it possible to give the saw box and other component parts of the saw device the design that is desired in order to achieve a more efficient sawing operation and increased ease of service. Furthermore, the sawchain as such has the advantage that it can be simply mounted on any existing saw device without this saw device requiring any modification.

Figure 2:
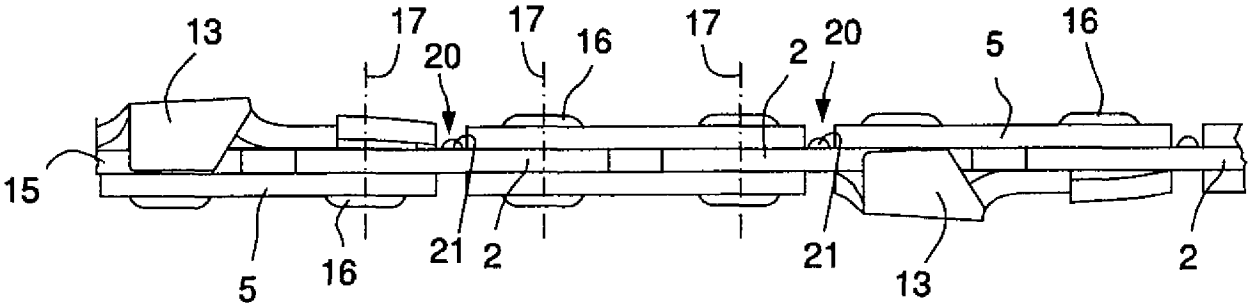
Figure 3:
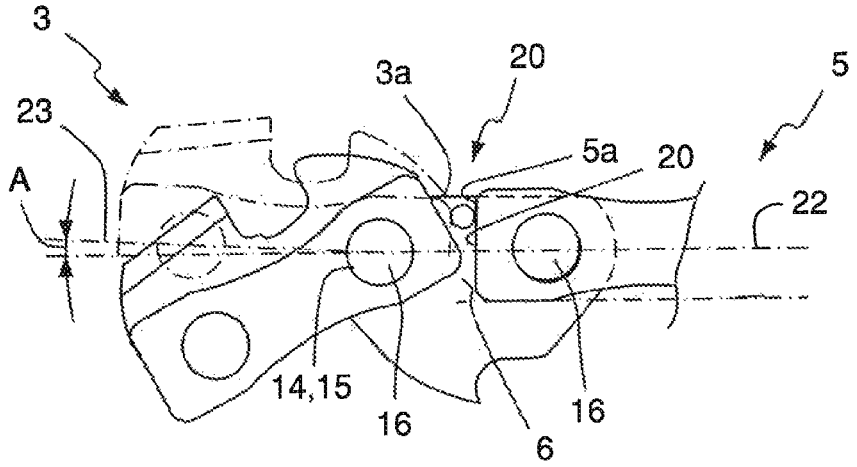
Figure 4:
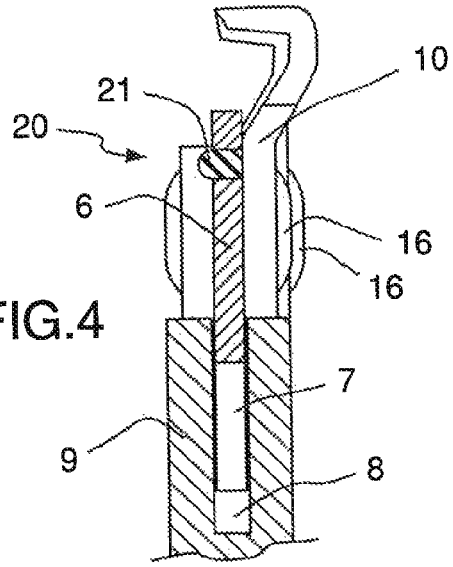
Figure 5:
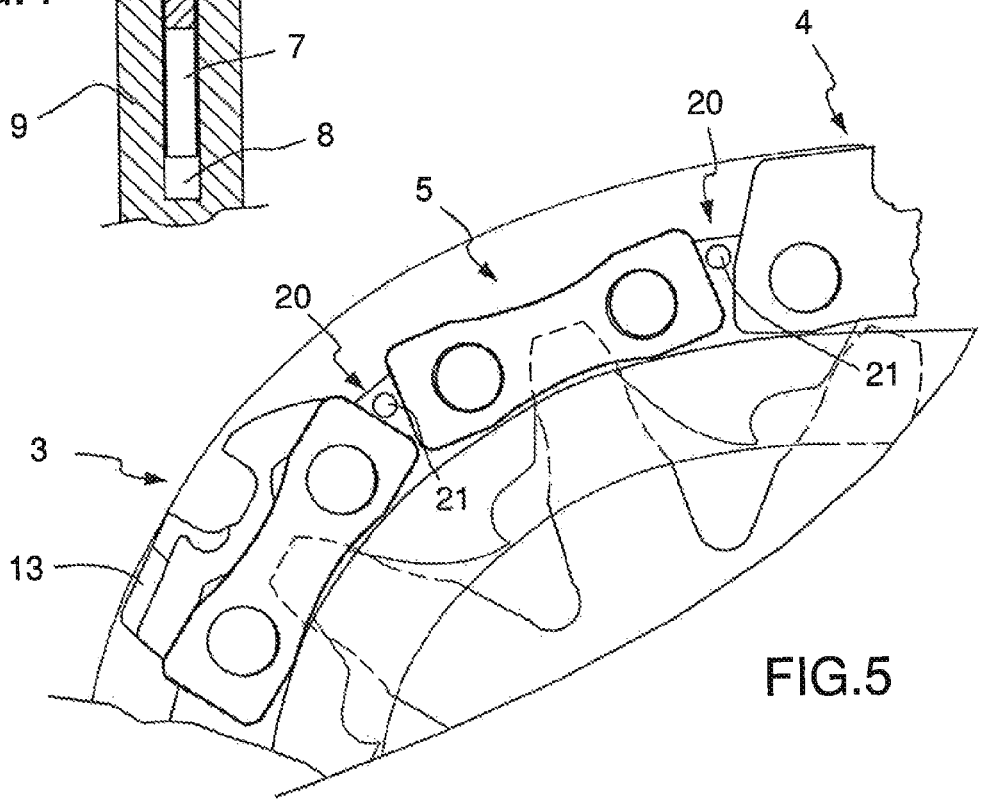

The invention will be described in more detail below with guidance from an embodiment and the attached drawings, in which:

FIG. 1 shows a side view of one part of a sawchain according to the invention, partially with hidden contour lines according to the invention, whereby the chain runs along the straight part of a guide bar, FIG. 2 shows the sawchain of FIG. 1 in a horizontal view, viewed from above, FIG. 3 shows in detail and at an enlarged scale a side view of two side links coupled to one driving link where the side link that is in front has been angled downwards in the principal plane of the guide bar relative to the subsequent second side link and is located in an alternative position in which it is prevented from swinging upwards past a line that passes through the two pivot points of the two links, FIG. 4 shows a cross-section through the sawchain and a part of the guide bar along the line IV-IV in FIG. 1, and FIG. 5 shows a section of the sawchain in FIG. 1 at a position in which it passes over one end of a guide bar that has a chain wheel that allows rotation.

Figure 8:
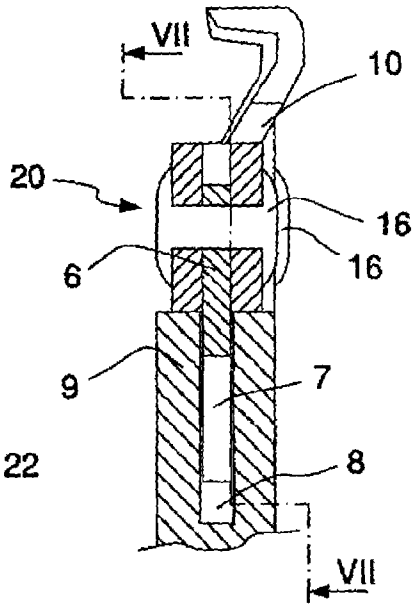
Figure 7:
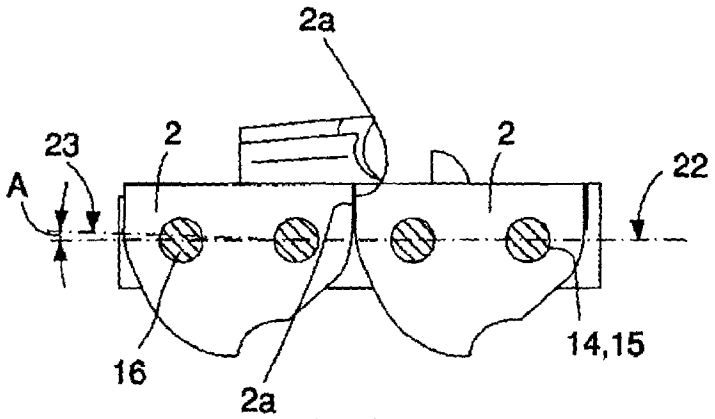
Figure 6:
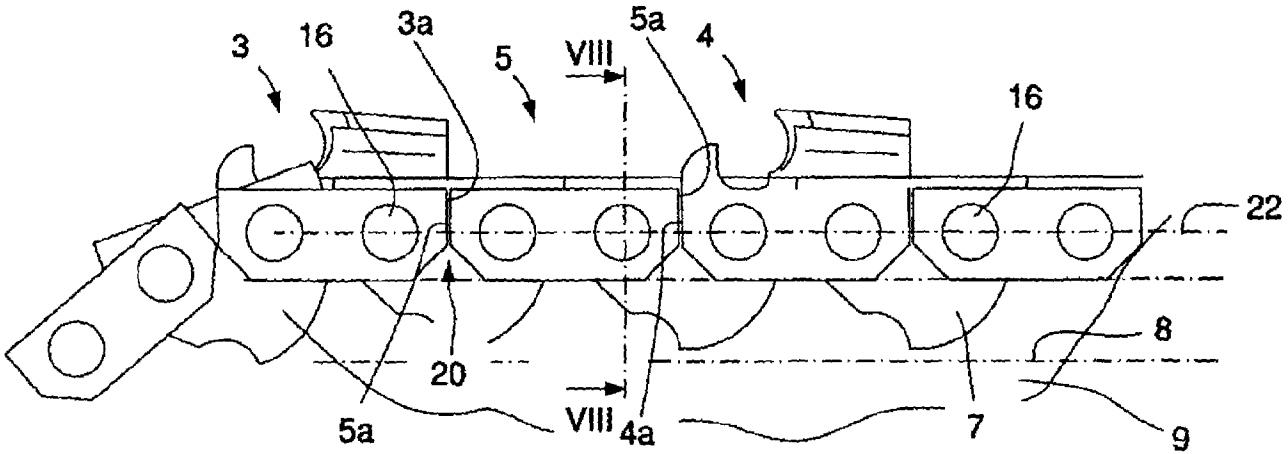
Figure 10:
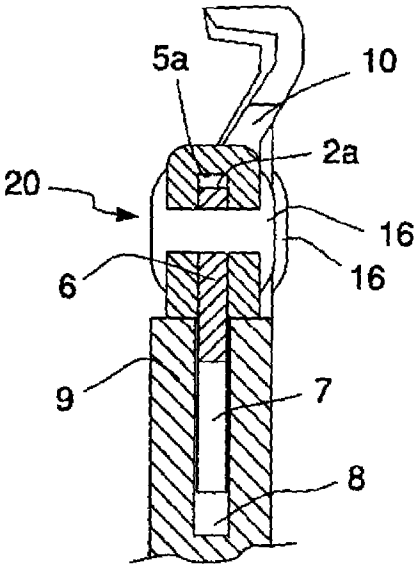
Figure 9:
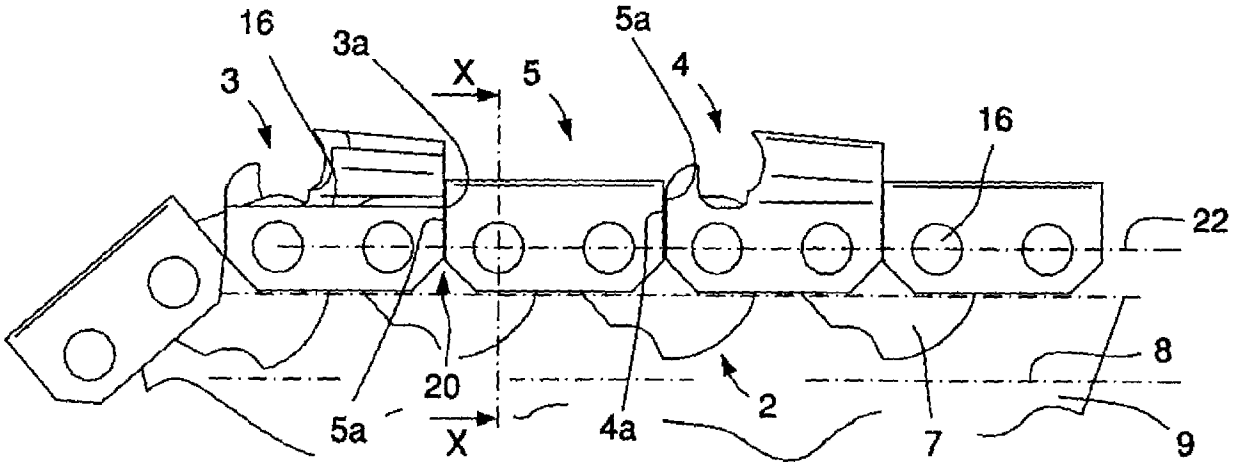

FIG. 6 shows a side view of one part of a sawchain in a first alternative embodiment of the invention, whereby the chain runs along the straight part of a guide bar, FIG. 7 shows a cross-section through the sawchain and a part of the guide bar along the line VII-VII in FIG. 8, at which two connected driving links are located and where the driving link that is in front is located in a locked position for oscillation around an axis upwards relative to the subsequent second driving link, FIG. 8 shows a cross-section through the sawchain and a part of the guide bar along the line VIII-VIII in FIG. 6, FIG. 9 shows a side view of one part of a sawchain in a second alternative embodiment of the invention, whereby the chain runs along the straight part of a guide bar, and FIG. 10 shows a cross-section through the sawchain and a part of the guide bar along the line X-X in FIG. 9.

FIG. 1 shows a sawchain 1 of the type that is typically used in the saw device of a forestry harvester. The sawchain 1 comprises central driving links 2 at a fixed distance from each other, and side links, consisting of left and right side cutting links 3 and 4, respectively, together with side connecting links 5 that unite the neighbouring driving links 2 in a manner that allows pivoting. Each driving link 2 comprises an upper link body 6 and a lower protruding tongue 7, which is located for control of the sawchain in a continuous groove 8 that runs around the periphery of a guide bar 9 and which interacts with a chain wheel in a manner that allows rotation for driving of the sawchain 1, which chain wheel is located at one end of the guide bar whereby cutting is carried out by rotation of the guide bar around an axis that coincides with the axis of the chain wheel. FIG. 5 is referred to with respect to the rotating chain wheel for driving the sawchain 1 around the guide bar 9. The sawchain 1 moves during normal operation clockwise around the guide bar 9, from the guide bar 9 at the driving wheel and back above the driving wheel, and the links rotate relative to each other in the principal plane of the guide bar 9.

The side links 3, 4 and 5 comprise a link body 10 the innermost edge of which faces the centre of the sawchain and glides along the outer edge 11 of the guide bar 9, a depth gauge 12 that extends outwards from the forward part of the link body of the cutting link, and a cutting element 13 that extends outwards from the link body 10 and that is located behind the depth gauge. The edge of the sawchain that has side links 3, 4 and 5 that face outwards provided with cutting elements 13 forms the processing part of the sawchain. The cutting elements 13 may be of any known type whereby the elements shown here are of the type known as "bucket" type. The cutting links 3, 4 are identical, with the exception of the fact that they have alternating right-side and left-side set.

Each one of the bodies 10 of the side links 3, 4, 5 is provided with a pair of rivet holes 14, while the bodies 2 of the central driving links are provided with a pair of rivet holes 15. The rivet holes are located close to the ends of the links and a rivet 16 passes through the rivet holes, this rivet connecting in a manner that allows pivoting each driving link 2 with a pair of side links 3, 4, 5 located opposite each other in a sideways direction. Each link has, as a consequence of this, a pair of pivot axes 17 that are located at a distance from each other when viewed in the longitudinal direction of the chain link, see FIG. 2.

A means 20 of limiting pivoting is arranged on the link body 6 of each driving link 2 in the form of a protrusion 21 that protrudes sideways from the link body in one direction and that is located in the region between two of the opposing edge sections 3*a*, 4*a*, 5*a* of the side links 3, 4, 5 (see FIG. 3). The protrusion 21 is located somewhat above the central line 22 through the rivet holes 15 and it is an advantage if it has been formed through local depression in the link body 6 by means of a punch impression tool, such that the material excess that is obtained bulges out sideways from the link body. One of the major advantages of this design is that the protrusion 21 can be arranged directly during the production of the driving link, in association with, for example, the punching out of the driving links from a sheet metal blank.

As is made most clear by FIGS. 3, 4 and 5, the opposing edge sections 3*a*, 4*a*, 5*a* of the two side links 14, 15, 16 are designed such that they interact with the protrusion in such a manner that the side links 3, 4, 5 and thus the sawchain 1 can be freely unlinked or curved in the principal plane of the guide bar in one direction, while only limited curvature or unlinking possibility in the principal plane of the guide bar is allowed in a second, opposite, direction. The side links 14, 15 16, which are located on opposite sides of each central driving link 2 in the direction of motion of the sawchain, can in this way be caused to pivot or rotate essentially freely when the sawchain located on the guide bar 9 moves in a sharply curved pathway around a driving wheel, or around the point of the guide bar as is shown in FIG. 5. This interaction, however, efficiently prevents the neighbouring side links 14, 15, 16 from pivoting or rotating relative to each other in the opposite direction. In other words, in the event of a sawchain 1 breaking, a free end of the sawchain will be prevented from swinging out from the end of the guide bar 9 and thus the possibility of the sawchain to carry out a whip-like movement backwards and forwards will be also prevented. It should be realised that any tendency for any one of the side links 14, 15, 16 at the free end of a broken chain to pivot backwards and forwards and to cause chain shot of the type described above will be efficiently prevented through the stop effect that is obtained by the interaction between the opposing edge sections 3*a*, 4*a* 5*a* of the side links 14, 15, 16 and the protrusion of the central driving link 12.

With particular reference to FIG. 3, a side view is there shown at an enlarged scale two side links 3 and 5 on a driving link 2 connected to the axis 16, where one of the side link 3, the forward side link, is angled downwards in the principal plane of the guide bar relative to the driving link 2 and is located in an alternative upwardly angled position, illustrated with a dash-dot contour line. The position of the forward side link 3, its principal axis, relative to the driving link 2 is denoted by the line 23, extending through the centre of the relevant rivet hole 14 of the side link. The line 22 denotes a central line that extends through the relevant rivet hole 15 of the rear driving link 2.

The means 20 of limiting the pivoting is thus so designed that the forward side link 3 is prevented from further pivoting upwards when the pivot axes 23, 22 of the two parts 3, 2 are essentially coincident, i.e. in the situation in which the angle denoted by A is 0°. Selection of the design of the means 20 of limiting pivoting will, of course, make it possible within the scope of the invention to allow the pivot axes 23, 22 intersect with a freely chosen angle A, i.e. the condition in which the central line 23 of the forward side link 3 is to intersect with the central line 22 of the driving link and at which further upwards pivoting around the joint axis 16 is to become blocked.

It is, of course, conceivable within the scope of the invention that it is possible to give the protrusion 21 another suitable design that has the same or a similar technical function, or that it is made from some other material than metal: it would be possible, for example, to attach an elastomeric material such as rubber onto the link body, preferably through vulcanisation. The interaction between the opposite edge sections 3*a*, 4*a*, 5*a* of the side links 14, 15, 16 and the protrusion 21, which interaction limits pivoting, would, in this manner, take place in a more compliant and force-absorbing manner.

Since the means 20 of limiting pivoting remains inactive while the sawchain 1 moves normally around the guide bar 9 and each one of the side links 14, 15, 16 bends itself around the central line of the chain in the centre of the principal plane of the guide bar, as is shown in FIG. 5, the present chain behaves exactly as any other known sawchain without loss of power when carrying out normal cutting operations of the type that is carried out by the saw device of a forestry harvester. In the event that a breakage occurs at any location around the circumference of the sawchain during sawing operations, the means 20 of limiting pivoting comes into operation and prevents the free ends of the broken chain from pivoting out from the end of the guide bar and thus also prevents the possibility of the chain end from carrying out a whip-like movement backwards and forwards. Thus the whiplash effect of a broken sawchain described in the introduction is avoided through the chain being subject to a limit on its ability to pivot for rotation in a backwards (upwards) direction from the guide bar, i.e. rotation in the principal plane of the guide bar 9 around the upper part of the chain 1 that is active during cutting operations. The design of the means 20 of limiting pivoting ensures that the flexibility of the chain for rotation around the guide bar 9 remains unaffected. Through the limited possibilities of the sawchain to be led or unlinked from its pathway around the guide bar, the powerful oscillatory movement that occurs for the free end of a broken sawchain is prevented in an efficient manner.

With reference to FIGS. 6-9, the invention is shown in a first alternative embodiment whereby parts with the same or an essentially similar function as those described above have been given the same reference numbers as these parts. Just as in the case described above, the sawchain comprises central driving links 2 at a fixed distance from each other, and side links, consisting of left and right side cutting links 3 and 4, respectively, together with side connecting links 5 that unite the neighbouring driving links 2 in a manner that allows pivoting, joined also in a manner that allows pivoting with the forward and rearward parts of the central driving links by means of axes 16 that are located at a distance from each other in the longitudinal direction of the chain. In contrast to what has been described above, the means 20 of limiting pivoting in this embodiment does not comprise a member 21 that protrudes in a horizontal direction and occupies a part of the space between the opposite edge sections 3*a*, 4*a*, 5*a* of neighbouring links 3, 4, 5. The opposite edge sections 3*a*, 4*a*, 5*a* of neighbouring links 3, 4, 5 have instead been given such an immediate form that they allow a forwardly located side link of the chain to pivot around the axis 16 in a first direction relative to a subsequent central driving link 2 but limit the ability of the side link to pivot around the axis in an opposite direction relative to the driving link 2.

As is made most clear by FIG. 7, not only have the opposite edge sections 3*a*, 4*a*, 5*a* of the neighbouring side links 3, 4, 5 been provided with means 20 of limiting pivoting, but also the opposite edge sections 2*a* of the neighbouring driving links 2 have been provided with an interacting design that limits pivoting as a complement in order to further increase the effect of limiting pivoting. The means 20 of limiting the pivoting is thus so designed that the forward side link 2 is prevented from further pivoting upwards when the pivot axes 23, 22 of the two parts 2, 2 are coincident, i.e. in the situation in which the angle denoted by A is 0°.

With reference now to the second alternative embodiment that is shown in FIGS. 9-10, and in which parts with the same or with essentially similar function as those described above have been given the same reference numbers. Just as in the case described above, the sawchain comprises central driving links 2 at a fixed distance from each other, and side links 5, consisting of left and right side cutting links 3 and 4, respectively, together with side connecting links 5 that unite the neighbouring driving links 2 in a manner that allows pivoting, joined also in a manner that allows pivoting with the forward and rearward parts of the central driving links by means of axes 16 that are located at a distance from each other in the longitudinal direction of the chain. An effect of limiting the ability to pivot is achieved through the interaction between the opposite edge parts 3*a*, 4*a*, 5*a* of the side links 3, 4, 5 and the interaction between the opposite edge parts 3*a*, 4*a*, 5*a* and 2*a*, respectively, between the side links 3, 4, 5 and the driving links 2. A closer study of FIG. 10 will make it clear that the side links 3, 4, 5 when viewed in cross-section are essentially U-shaped and essentially surround the edge parts 2*a* of the driving links 2 that act in order to limit pivoting.

The present invention is not limited to what has been described above and shown in the drawings: it can be changed and modified in a number of different ways within the scope of the innovative concept specified in the attached patent claims.

The invention claimed is:

1. A method for a sawchain for a forestry harvester in order to limit rapid outward movement of a free end of the sawchain relative to a guide bar if the sawchain breaks during sawing, the guide bar having a principal plane in which the sawchain travels during normal operation, the method comprises the steps:

providing a sawchain with a means of limiting pivoting that protrudes from and in a direction orthogonal to a plane of a face of a driving link in the sawchain, the plane of the face of the driving link parallel to the principal plane of the guide bar, wherein the means of limiting pivoting allows a forwardly located link of the sawchain to pivot in an inward direction relative to a subsequent link while limiting the ability of the forwardly located link to pivot in an outward direction relative to the subsequent link, wherein the means of limiting pivoting is located completely above, in the outward direction, a central line through pivoting axes of the forwardly located link and the subsequent link, wherein the means of limiting pivoting is arranged at a region between pivot points of the forwardly located link and the subsequent link, wherein the means of limiting pivoting limits pivoting solely through interaction with opposite side edge parts of the forwardly located link and the subsequent link, with the opposite side edge parts of the forwardly located link and the subsequent link generally planar and facing one another, and wherein the means of limiting pivoting comprises a member that protrudes in the direction orthogonal, protruding away from the principal plane, the member having a round external surface that abuts against the generally planar side edge parts of the forwardly located link and the subsequent link, and wherein the protruding member forms a stop for the opposite side edge parts of the forwardly located link and the subsequent link, to prevent pivoting when in contact with the opposite side edge parts;

driving the sawchain around the guide bar with a driving wheel that is located at one end of the guide bar, and sawing a tree trunk by turning the guide bar around an axis of rotation.

2. The method according to claim 1, wherein the forwardly located link of the sawchain is allowed to pivot freely, without limitation, in the inward direction relative to the subsequent link, with the means of limiting pivoting preventing pivoting in the outward direction relative to the subsequent link.

3. The method according to claim 1, wherein the sawchain is transported during normal operation from the guide bar at the driving wheel and rotates back above the driving wheel.

4. A sawchain to run around a guide bar of a saw device of a forestry harvester, the guide bar having a principal plane in which the sawchain travels during normal operation, comprising: a series of links in the form of central driving links and side links connected in a manner that allows pivoting with forward and rear parts of the central driving links by means of axes that are located at a distance from each other in the longitudinal direction of the chain, wherein the side links define cutting links, and on each central driving link, a means of limiting pivoting that protrudes from and in a direction orthogonal to a plane of a face of the central driving link, the plane of the face of the central driving link parallel to the principal plane of the guide bar, the means of limiting pivoting allows through interaction with neighboring side links a forwardly located side link of the chain to pivot around its respective axis in a first direction relative to a subsequent side link but limits the ability of the forwardly located side link to pivot around the respective axis in an opposite second direction relative to the subsequent side link, the means of limiting pivoting being located completely above, in the opposite second direction, a central line through the axes of the central driving link, wherein the means of limiting pivoting is arranged at the region between the pivot points of the neighboring links, wherein the means of limiting pivoting limits pivoting solely through interaction with opposite side edge parts of the neighboring links that are generally planar, with the generally planar opposite side edge parts of the neighboring links facing one another, wherein the means of limiting pivoting comprises a member that protrudes in the orthogonal direction from the driving link, protruding away from the principal plane and having a generally round surface, the means of limiting pivoting abuts against respective the generally planar opposite edge parts of the neighboring side links, and wherein the protruding member forms a stop for the opposite side edge parts of the neighboring side links, to prevent pivoting when in contact with the opposite side edge parts.

5. The sawchain according to claim 4, wherein the means of limiting pivoting is so configured that the forwardly located link is prevented from further pivoting in the second direction when principal axes of the links align in the condition in which the angle of intersection between the principal axes of neighbouring links is essentially 0°.

6. The sawchain according to claim 4, wherein, if the sawchain breaks, the means of limiting pivoting prevents rapid outward movement of a free end of the sawchain relative to the guide bar.

7. The sawchain according to claim 4, wherein the member that protrudes comprises a portion of the driving link that has been machined to bulge outward from the plane of the face of the central driving link.

8. The sawchain according to claim 4, wherein for each of the central driving links, the means of limiting pivoting does not limit pivoting of the forwardly located side link in the first direction relative to the subsequent side link.

9. The sawchain according to claim 4, wherein for each of the central driving links, the means for limiting pivoting is closer to a top edge of the central driving link that is furthest in the second direction, than the means for limiting pivoting is to the central line.

10. The sawchain according to claim 4, wherein for each of the central driving links, the means of limiting pivoting includes a punched part of the central driving link that protrudes from the plane of the face of the central driving link.

11. The sawchain according to claim 7, wherein the portion of the driving link that has been machined is a punched part of the central driving link, which protrudes from the plane of the face of the central driving link.

12. A sawchain to run around a guide bar of a saw device of a forestry harvester, the guide bar having a principal plane in which the sawchain travels during normal operation, comprising:

a series of links in the form of central driving links and side links connected in a manner that allows pivoting with forward and rear parts of the central driving links by means of axes that are located at a distance from each other in the longitudinal direction of the chain, wherein the side links define cutting links, and on each central driving link, a means of limiting pivoting that protrudes from and in a direction orthogonal to a plane of a face of the central driving link, the plane of the face of the central driving link parallel to the principal plane of the guide bar, the means of limiting pivoting allows through its-interaction with neighbouring side links a forwardly located side link of the chain to pivot around its respective axis in a first direction relative to a subsequent side link but limits the ability of the forwardly located side link to pivot around the respective axis in an opposite second direction relative to the subsequent side link, the means of limiting pivoting being located completely above, in the opposite second direction, a central line through the axes of the central driving link, wherein the means of limiting pivoting comprises a shock-absorbent elastomer.

* * * * *